US008671491B1

(12) United States Patent
Pijor et al.

(10) Patent No.: US 8,671,491 B1
(45) Date of Patent: Mar. 18, 2014

(54) CLEANING AND STORAGE UNIT FOR PACIFIERS

(76) Inventors: Dustin A. Pijor, Houma, LA (US); Brittany Pijor, Houma, LA (US)

( * ) Notice: Subject to any disclaimer, the term of this patent is extended or adjusted under 35 U.S.C. 154(b) by 88 days.

(21) Appl. No.: 13/486,060

(22) Filed: Jun. 1, 2012

(51) Int. Cl.
*A46B 13/04* (2006.01)

(52) U.S. Cl.
USPC ..... 15/21.1

(58) Field of Classification Search
USPC ..... 15/21.1, 21.2
See application file for complete search history.

(56) References Cited

U.S. PATENT DOCUMENTS 3,774,256 A * 11/1973 Gauthier ..... 15/21.1
4,381,574 A 5/1983 Benkovsky
5,400,455 A 3/1995 Crossley
5,402,810 A 4/1995 Donley
6,343,612 B1 2/2002 Dahl
6,708,363 B2 3/2004 Larsen
7,207,342 B1 4/2007 Daniels
7,967,020 B2 * 6/2011 Jimenez ..... 134/135
2004/0040586 A1 3/2004 Kumar

* cited by examiner

*Primary Examiner* — Randall Chin
(74) *Attorney, Agent, or Firm* — Robert C. Montgomery; Montgomery Patent & Design

(57) ABSTRACT

A cleaning and storage unit for pacifiers comprises a cylindrical enclosure including a top center with a hinged lid which swings open to expose an internal cleaning assembly which comprises a cavity containing a cleaning fluid and a plurality of brushes. A standard pacifier can be inserted nipple-first into a top opening and against the brushes which automatically starts an electric motor which spins the brushes, thereby cleaning the pacifier. After a suitable period of time, the cleaned pacifier is removed. Clean pacifiers may be stored on removable hooks located around the perimeter of the enclosure.

17 Claims, 3 Drawing Sheets

CLEANING AND STORAGE UNIT FOR PACIFIERS

RELATED APPLICATIONS

There are currently no applications co-pending with the present application.

FIELD OF THE INVENTION

The present subject matter is directed towards baby pacifiers. More particularly, the present invention is directed towards devices for cleaning and storing baby pacifiers.

BACKGROUND OF THE INVENTION

As any parent will surely attest, the pacifier is an indispensable piece of equipment in the raising of a child. A simple pacifier allows a parent to satisfy a child's natural instinct to suckle, which is an activity that has been proven to calm and quiet the child. This enables a care-giver to obtain peace of mind and time to do other tasks while also assisting the child to relax and sleep.

As with any item exposed to a child the caregiver must ensure that a pacifier is kept as clean and germ-free as possible. However, it is extremely difficult to determine whether or not a pacifier is clean or dirty by simply looking at it. While ideally pacifiers are cleaned at a sink with soap and plenty of running hot water, access to a sink having soap and running hot water is not always possible. As an example, the ideal items are not available when a parent is running to the store or performing other errands away from home. At such times some parents simply resort to placing the nipple in their own mouth to remove dirt and contaminants. In actuality this only exposes the parent to germs and bacteria on the pacifier while leaving behind a wealth of other germs and bacteria which can result in thrush and other problems for the child.

Accordingly, there exists a need for devices that can provide cleaned and sanitized pacifiers without using running water, while still supporting a healthy infant, and without creating health risks to care providers. Beneficially, such a device would be both portable, easy to use, and provide for save pacifier storage when they are not in use.

SUMMARY OF THE INVENTION

The present invention provides for portable devices that clean pacifiers without the use of running water and that can store cleaned pacifiers in a readily accessible manner. Beneficially, those principles provide for portable devices that clean pacifiers and that are easy to use.

A pacifier cleaning system in accord with the present invention comprises an upper enclosure having a central aperture over a cavity. A hinged cover is attached to the upper enclosure. That hinged cover selectively covers the central aperture. A reservoir bottom cup is in the cavity below the hinged cover while a reservoir cover selectively closes the reservoir bottom cup with a watertight closure. Inside the reservoir bottom cup is a cleaning assembly with rotatable bristles that are attached to a cleaning motor via a watertight coupling. When the cleaning assembly is pressed down it activates a motor switch which applies power from a battery to the cleaning motor. This turns the rotatable bristles which cleans a pacifier nipple inserted between the bristles.

A bottom base enclosure connects to the upper enclosure to protect the internal components and to retain the battery. Cleaned pacifiers can be stored on one (1) or more repositionable storage hooks disposed in slots formed between the bottom base enclosure and the upper enclosure.

Preferably, the watertight coupling includes engagement pins that mate with the cleaning assembly and a grommet between a motor shaft and the cleaning assembly and the hinged cover is attached to the upper enclosure by mounting pins.

Beneficially the cleaning assembly includes a cleaning fluid retained in an enclosure. The cleaning assembly also includes recirculation tunnels having lower recirculation apertures and upper recirculation apertures. Drain apertures in the enclosure enable cleaning fluid to flow into the lower recirculation apertures. When the motor turns, the cleaning fluid passes through the drain apertures into the lower recirculation apertures, up the recirculation tunnels and out of the upper recirculation apertures onto the rotatable bristles. Those rotatable bristles can be configured as an upper brush and a lower brush that are located within the enclosure.

The bottom base enclosure preferably has a power input jack for applying power to recharge the battery by way of a battery charger. Power from the battery is also applied to a light within the upper enclosure via a light switch. When the light switch is activated, the light emitted passes through the light cover.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
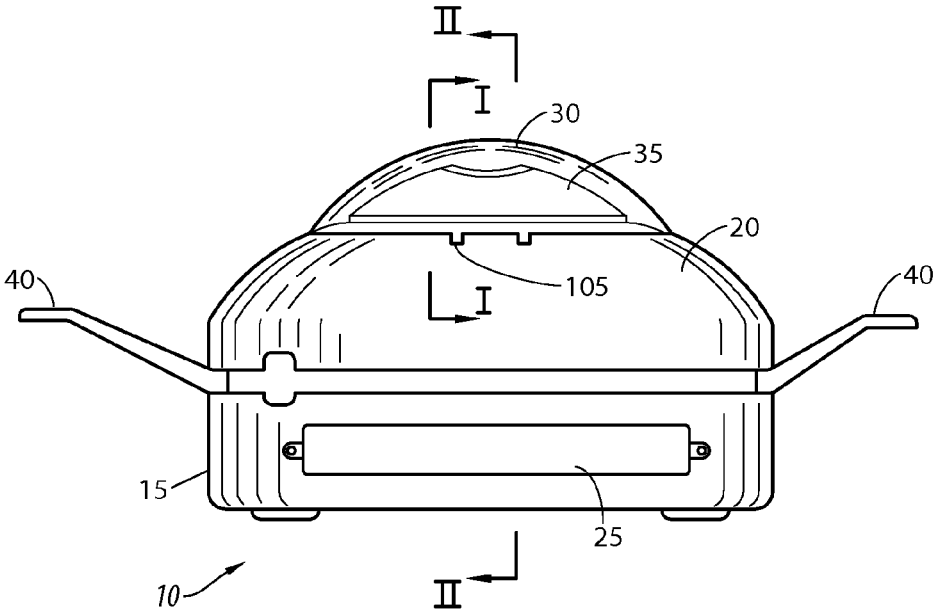
FIG. 1 is a side view of an automated pacifier cleaning system 10 that is in accord with the principles of the present invention.

10 automated pacifier cleaning system
15 bottom base enclosure
20 upper enclosure
25 battery access door
30 cover
35 reservoir cover
40 clean pacifier storage hooks
45 slot openings
50 motor
55 night light lamp
60 night light cover
65 night light pushbutton switch
70 reservoir bottom cup
75 cleaning assembly

76 enclosure
77 drain aperture
78 recirculation tunnel
79*a* lower recirculation aperture
79*b* upper recirculation aperture
80 upper brush
81 lower brush
84 recharging jack
85 recharging adapter
90 first direction arrow
95 locking clips
100 mounting flange
105 mounting pin
110 female mounting aperture
115 second direction arrow
120 mounting coupling
125 shaft
130 engagement pins
135 engagement pin receptacles
140 bottom mounting plate
145 third direction arrows
150 rubber grommet
155 motor switch
160 night light cavity
165 recharging regulator circuit
170 rechargeable battery pack
175 cleaning fluid
180 center opening

DETAILED DESCRIPTION OF THE PREFERRED EMBODIMENT

The best mode for carrying out the invention is presented in terms of its preferred embodiment, herein depicted within FIGS. 1 through 7, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention are presented in terms of a preferred embodiment is depicted in FIGS. 1-7. Referring now to FIG. 1, a side view of an automated pacifier cleaning system 10 that is in accord to the preferred embodiment of the present invention, the automated pacifier cleaning system 10 includes a bottom base enclosure 15 and an upper enclosure 20. Those enclosures are envisioned are being made of plastic using an injection molding process.

The bottom base enclosure 15 has a battery access door 25 which houses batteries for portable operation. The upper enclosure 20 retains a clear, protective hinged cover 30 which opens for access to the interior of the automated pacifier cleaning system 10. Beneficially, the cover 30 forms a water-resistant seal with the remainder of the upper enclosure 20. Visible through the cover 30 and within the upper enclosure 20 is a reservoir cover 35, whose function is subsequently described in more detail. Also shown in FIG. 1 are clean pacifier storage hooks 40 upon which a user can store cleaned pacifiers.

To provide a useful scale the overall size of the automated pacifier cleaning system 10 is approximately six inches (6 in.) in diameter and five to six inches (5-6 in.) tall. Under normal operation the automated pacifier cleaning system 10 would be placed on a countertop for use.

Figure 2:
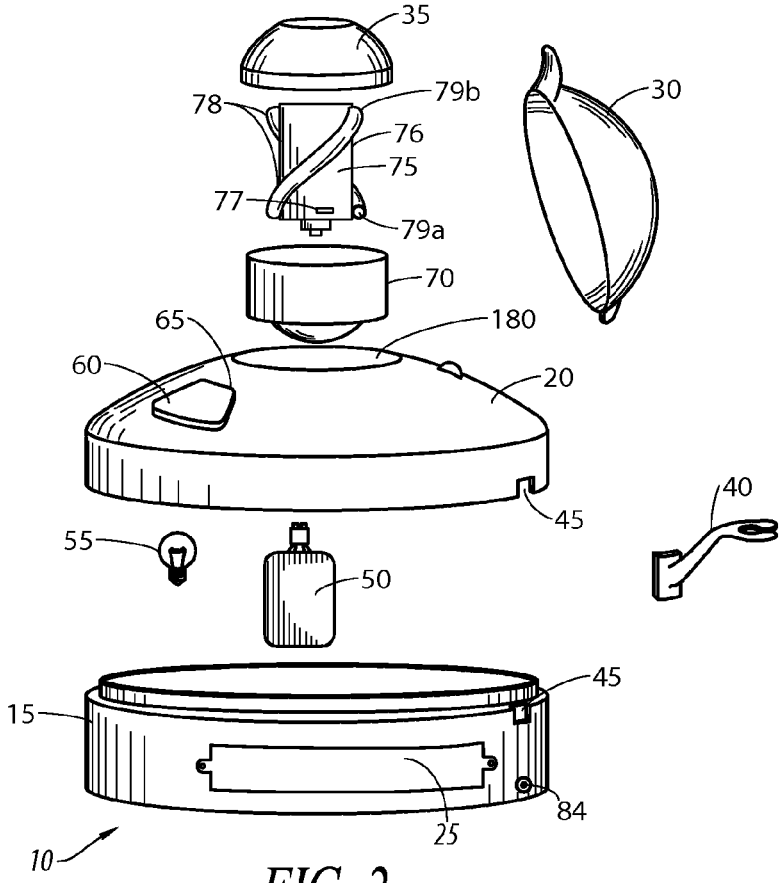
FIG. 2 is an exploded view of the automated pacifier cleaning system 10 shown in FIG. 1.

FIG. 2 shows an exploded view of the automated pacifier cleaning system 10. As shown, the automated pacifier cleaning system 10 includes the bottom base enclosure 15, the upper enclosure 20, the battery access door 25, the cover 30, the reservoir cover 35, a central aperture 180, and the clean pacifier storage hooks 40. The clean pacifier storage hooks 40 selectively fit into slot openings 45 (only one (1) shown) that are located between the bottom of the upper enclosure 20 and the top of the bottom base enclosure 15. The central aperture 180 provides an opening to access internal features within the automated pacifier cleaning system 10. The automated pacifier cleaning system 10 also includes a motor 50 within the upper enclosure 20 that provides the mechanical power necessary to clean pacifiers. Additionally, there is a night light lamp 55 that is located next to the motor 50 and immediately below a night light cover 60 of a night light pushbutton switch 65.

Figure 5:
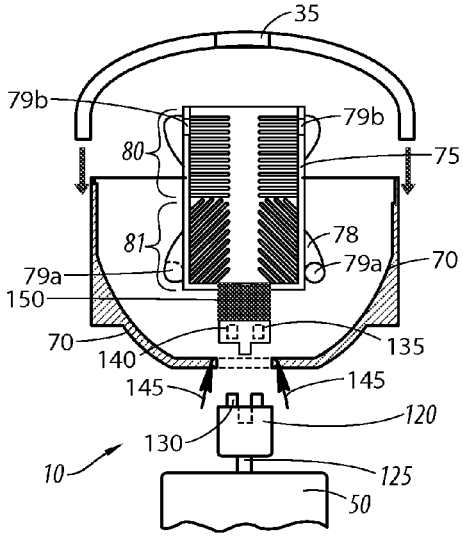
FIG. 5 is a section view of the automated pacifier cleaning system 10 taken along line I-I of FIG. 1.

Cleaning is performed in the upper enclosure 20 within a waterproof reservoir bottom cup 70 that houses a replaceable cleaning assembly 75. The cleaning assembly 75 comprises an enclosure 76, a pair of drain apertures 77, a pair of recirculation tunnels 78, a pair of lower recirculation apertures 79*a*, a pair of upper recirculation apertures 79*b*. Referring now to FIG. 5, the cleaning assembly further includes an upper brush 80, and a lower brush 81 within the enclosure 76 In use, the cleaning assembly 75 is inserted into the reservoir bottom cup 70 which is subsequently filled with a cleaning fluid 175 (reference FIG. 6), which may be water and/or a disinfectant that is safe for infants. In operation a pacifier is placed in the center of the cleaning assembly 75 where the brushes 80, 81 and the cleaning fluid 175, as well as the rotary action of the cleaning assembly 75 act to cleanse the pacifier.

Figure 6:
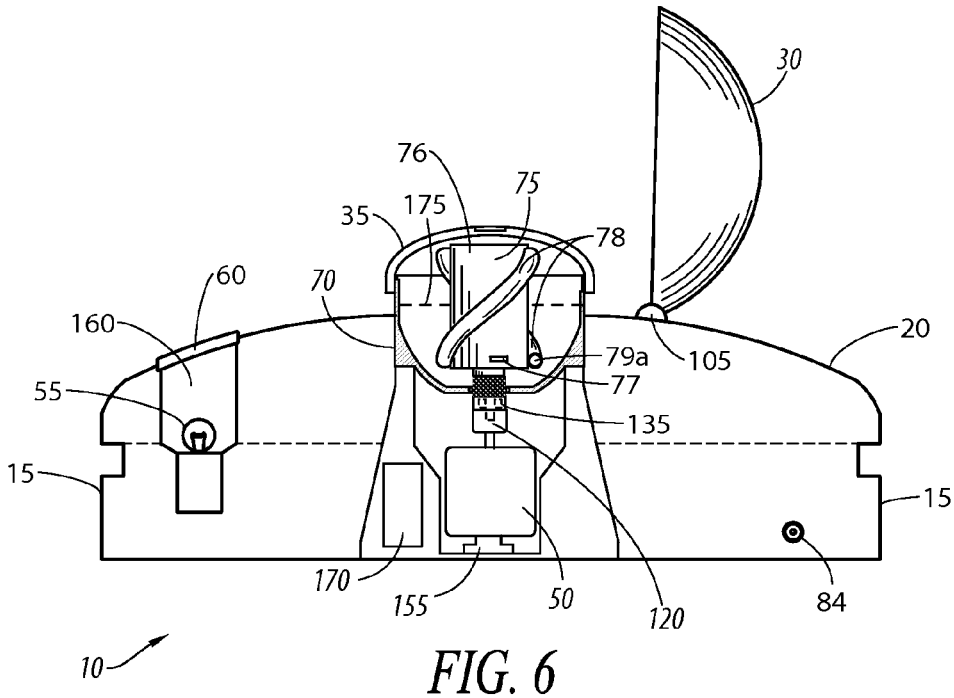
FIG. 6 is a section view of the automated pacifier cleaning system 10 taken along line II-II, of FIG. 1; and, FIG. 7 is an electrical schematic depicting the electrical components of the automated pacifier cleaning system 10 shown in FIGS. 1-6.

Referring to FIGS. 2, 5, and 6, the automated pacifier cleaning system 10 circulates the cleaning fluid 175 from the bottom of the reservoir bottom cup 70 to the top of the cleaning assembly 75 through the recirculation tunnels 78 using centrifugal force created by spinning the cleaning assembly 75. The recirculation tunnels 78 are spiral-shaped, open-ended tubular members integrally molded along opposing outer surfaces of the enclosure 76. During recirculation, the cleaning fluid 175 enters the lower recirculation aperture 79*a* of each recirculation tunnel 78 where the cleaning fluid 175 is propelled upward through the recirculation tunnels 78 to re-enter the enclosure 76 via the upper recirculation apertures 79*b*. The cleaning fluid 175 cascades down over the brushes 80, 81 toward the bottom of the enclosure 76 and passes through a pair of drain apertures 77 near the bottom of the enclosure 76. The drain apertures 77 allow the cleaning fluid 175 to re-enter the reservoir bottom cup 70.

Referring to FIG. 5, the brushes 80, 81 comprise a plurality of synthetic or natural bristles that form an overall cylindrical shape. The brushes 80, 81 are permanently attached to the inside of the enclosure 76 and extend toward the center of the enclosure 76. The upper brush 80 has horizontally extending bristles while the bristles of the lower brush 81 angle upward, beneficially at approximately forty-five degrees (45°). This bristle arrangement provides multi-angular pacifier cleaning.

Referring to FIGS. 2 and 5, the reservoir cover 35 is envisioned as being made from a soft expandable plastic or rubber material. This enables the bottom of the reservoir cover 35 to expand across the top of the reservoir bottom cup 70 so as to provide a water-tight seal for the enclosed cleaning assembly 75. The cover 30, the reservoir cover 35, the reservoir bottom cup 70, and the cleaning assembly 75 may be easily removed for cleaning as needed. As previously noted the clean pacifier storage hooks 40 are adjustable and removable and can be slid and repositioned as needed. The bottom base enclosure 15 also houses a recharging jack 84 that provides an electrical connection for a recharging adapter 85 (see FIG. 7).

Figure 3:
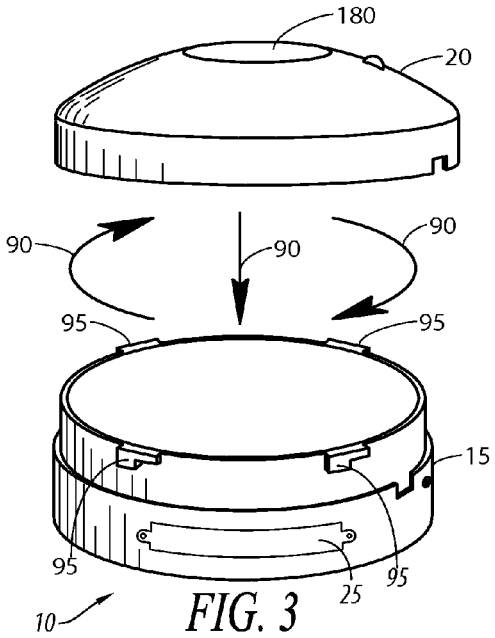
FIG. 3 is an assembly diagram depicting components of the automated pacifier cleaning system 10 shown in FIG. 1 and in FIG. 2.

Referring now to FIG. 3, an assembly diagram depicting various components of the automated pacifier cleaning system 10, the upper enclosure 20 and the bottom base enclosure 15 can be disassembled by a twist-to-lock motion defined by first direction arrows 90 to lock and release from four (4) locking clips 95. This allows for easy replacement and cleaning of the components described in FIG. 1.

Figure 4:
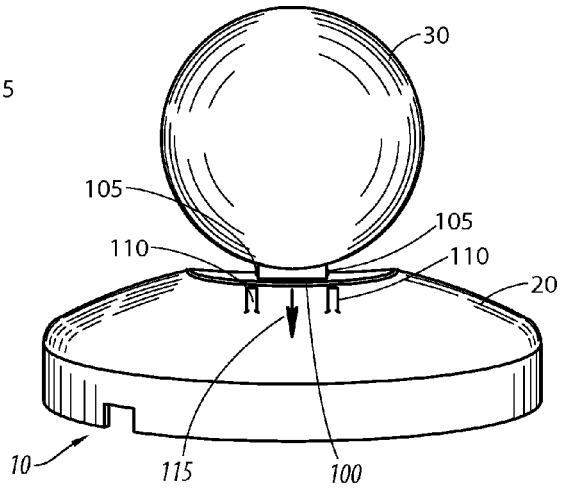
FIG. 4 is another assembly diagram depicting assorted components of the automated pacifier cleaning system 10 shown in FIGS. 1-3.

Referring next to FIG. 4, another assembly diagram depicting various components of the automated pacifier cleaning system 10, the cover 30 is retained by a mounting flange 100 having two (2) snap-in mounting pins 105. The mounting pins 105 engage with a pair of integrally-molded female mounting apertures 110 via a friction fit. Engagement is performed by pushing the cover 30 along a travel path defined by a second direction arrow 115. This operation can be reversed by reversing the second direction arrow 115 for removal.

Refer now to FIG. 5, which is a section view of the automated pacifier cleaning system 10 taken along line I-I of FIG. 1. A mounting coupling 120 sits on top of the shaft 125 of the motor 50. The mounting coupling 120 includes a pair of engagement pins 130 which correspond to a pair of engagement pin receptacles 135 on a bottom mounting plate 140 of the cleaning assembly 75. Engagement is performed by pushing the engagement pins 130 into the engagement pin receptacles 135 along a travel path defined by a set of third direction arrows 145. A rubber grommet 150 is anchored to the bottom surface of the cleaning assembly 75 to enable the rotary motioning of the cleaning assembly 75 as well as providing rotational waterproof sealing against a bottom opening portion of the reservoir bottom cup 70.

Refer now to FIG. 6, which is a section view of the automated pacifier cleaning system 10 taken along line II-II of FIG. 1. The upper enclosure 20 and the bottom base enclosure 15 mate as described above with reference to FIG. 3. The cover 30 is shown in an open and ready to use state. In use, the user would pour a volume of suitable cleaning fluid 175 into the reservoir bottom cup 70 such that the cleaning assembly 75 is partially or completely submerged.

The night light lamp 55 is located immediately below the night light cover 60 in a night light cavity 160 so that heat from the night light lamp 55 does not dry out the cleaning assembly 75. The night light lamp 55 enables the automated pacifier cleaning system 10 to be used at night or during low ambient light conditions. The motor 50, its mounting coupling 120, and the engagement pin receptacles 135 are mated together as described above with reference to FIG. 5. Recharging power is input by the recharging jack 84. Activation of the motor 50 is enabled by a motor switch 155 whenever the assembly formed by the motor 50, the reservoir cover 35, the reservoir bottom cup 70 and the cleaning assembly 75 is pushed down. The motor switch 155 is envisioned to be a normally-open spring-return device capable of lifting the assembly formed by the motor 50, the reservoir cover 35, the reservoir bottom cup 70, and the cleaning assembly 75 when not activated by the user.

Figure 7:
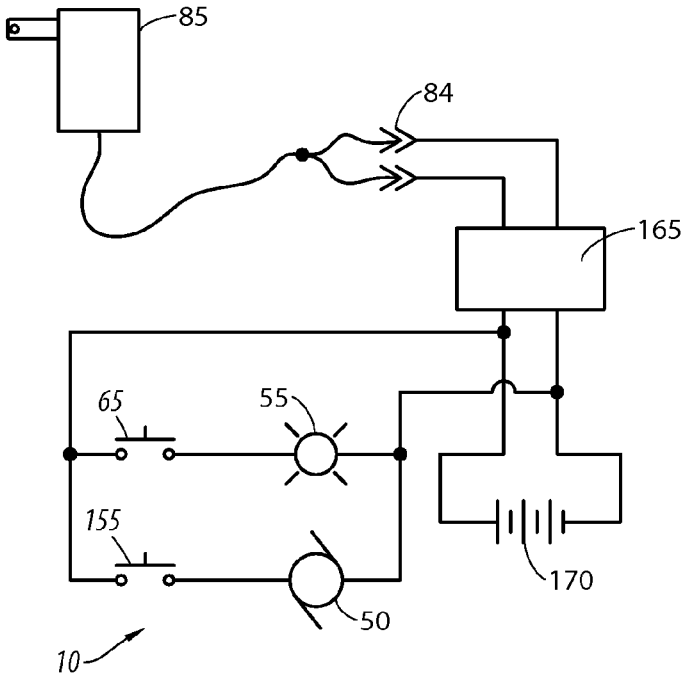

Referring finally to FIG. 7, an electrical schematic depicting the electrical components of the automated pacifier cleaning system 10. Power to operate the automated pacifier cleaning system 10 is provided via a recharging adapter 85 which connects to the recharging jack 84. That input power is applied to a charging regulator circuit 165 that charges a rechargeable battery pack 170. Power from the rechargeable battery pack 170 is selectively routed by the night light push-button switch 65 to the night light lamp 55 and/or by the motor switch 155 to the motor 50. The use of the rechargeable battery pack 170 enables true independent operation of the automated pacifier cleaning system 10.

It is envisioned that other styles and configurations of the present invention can be easily incorporated into the teachings of the present invention. While only one particular configuration is shown and described, that is for purposes of clarity and disclosure and not limitation of scope.

The automated pacifier cleaning system 10 can be used by the common user in a simple and effortless manner with little or no training. It is envisioned that the automated pacifier cleaning system 10 would be constructed in general accordance with FIG. 1 through FIG. 7. The majority of the components used in the automated pacifier cleaning system 10 preferably will be made of plastic using an injection molding process. Electrical connections should be made as shown in FIG. 7, and the rechargeable battery pack 170 should be charged by electrically connecting the recharging adapter 85 to the recharging jack 84 for a suitable period of time. Finally, a volume of a suitable cleaning fluid 175 should be poured into the reservoir bottom cup 70 such that the cleaning assembly 75 is partially or completely submerged. At this point in time, the automated pacifier cleaning system 10 is ready for operation.

During use, the automated pacifier cleaning system 10 would normally be placed upon a suitable horizontal surface. With a dirty or soiled pacifier in one (1) hand, using the same hand (back surface) the cover 30 would be opened. The latex or silicone portion of the pacifier is then inserted through the opening in the reservoir cover 35 and pushed downward such that the motor switch 155 is closed and the motor 50 activated to turn the cleaning assembly 75. After a suitable period of time, envisioned being approximately ten to fifteen seconds (10-15 sec.), the cleaned and sanitized pacifier is removed and placed on an open clean pacifier storage hook 40 to dry. The parent or care provider can then take another clean pacifier from a clean pacifier storage hook 40 for an infant.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A pacifier cleaning system, comprising:

an upper enclosure having a central aperture over a cavity;

a hinged cover attached to said upper enclosure for selectively covering said central aperture;

a reservoir bottom cup in said cavity and displaced below said hinged cover;

a reservoir cover for selectively closing said reservoir bottom cup with a watertight closure;

a cleaning assembly comprised of a plurality of rotatable bristles inside said reservoir bottom cup;

a cleaning motor attached to said rotatable bristles via a watertight coupling;

a battery; and, a motor switch operatively connecting to said cleaning motor;

wherein said plurality of rotatable bristles are configured to allow insertion of a pacifier nipple into said cleaning assembly;

wherein said motor switch is activated when said cleaning assembly is pressed down; and, wherein said motor turns said plurality of rotatable bristles to clean an inserted nipple when said motor switch is activated.

2. The pacifier cleaning system according to claim 1, further including a bottom base enclosure connected to said upper enclosure, said bottom base enclosure retaining said battery.

3. The pacifier cleaning system according to claim 2, further including at least one clean pacifier storage hook disposed between said bottom base enclosure and said upper enclosure.

4. The pacifier cleaning system according to claim 3, wherein said clean pacifier storage hook can be repositioned.

5. The pacifier cleaning system according to claim 2, further including a recharging jack on said bottom base enclosure for applying power to recharge said battery.

6. The pacifier cleaning system according to claim 5, further including a battery charger disposed between said jack and said battery.

7. The pacifier cleaning system according to claim 2, further including a light within said upper enclosure.

8. The pacifier cleaning system according to claim 7, further including a light switch attached to said upper enclosure, wherein said light is powered by said battery when said light switch is activated.

9. The pacifier cleaning system according to claim 8, further including a light cover over said light.

10. The pacifier cleaning system according to claim 2, wherein said upper enclosure and said bottom enclosure are disassembled by a twist-to-lock motion.

11. The pacifier cleaning system according to claim 3, wherein said clean pacifier storage hook fits into a slot between said upper enclosure and said bottom base enclosure.

12. The pacifier cleaning system according to claim 1, wherein said watertight coupling has engagement pins that mate with said cleaning assembly and wherein said watertight coupling includes a grommet between a motor shaft and said cleaning assembly.

13. The pacifier cleaning system according to claim 1, wherein said hinged cover includes mounting pins for attaching said hinged cover to mounting posts on said upper enclosure.

14. The pacifier cleaning system according to claim 1, wherein said cleaning assembly includes a cleaning fluid.

15. The pacifier cleaning system according to claim 14, wherein said cleaning assembly further includes an enclosure for retaining said cleaning fluid, a pair of recirculation tunnels having a pair of lower recirculation apertures and a pair of upper recirculation apertures, and a pair of drain apertures connected to said lower recirculation apertures.

16. The pacifier cleaning system according to claim 15, wherein when said motor turns said cleaning fluid passes through said pair of drain apertures into said lower recirculation apertures, up said pair of recirculation tunnels, out of said pair of upper recirculation apertures onto said plurality of rotatable bristles.

17. The pacifier cleaning system according to claim 1, wherein said plurality of rotatable bristles are configured as an upper brush and a lower brush within said enclosure.

* * * * *